US006784355B2

(12) United States Patent
Gyoten et al.

(10) Patent No.: US 6,784,355 B2
(45) Date of Patent: Aug. 31, 2004

(54) ELECTRONIC MUSICAL APPARATUS CUSTOMIZING METHOD

(75) Inventors: Yasuaki Gyoten, Hamamatsu (JP); Shigeki Akahori, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/210,503

(22) Filed: Jul. 31, 2002

(65) Prior Publication Data

US 2003/0024376 A1 Feb. 6, 2003

(30) Foreign Application Priority Data

Aug. 6, 2001 (JP) ..... 2001-238264

(51) Int. Cl.[7] ..... G10H 1/06; G10H 7/00

(52) U.S. Cl. ..... 84/622

(58) Field of Search ..... 84/600, 622, 645, 84/659

(56) References Cited

U.S. PATENT DOCUMENTS 5,892,171 A 4/1999 Ide
6,180,862 B1 * 1/2001 Hirano ..... 84/601
6,184,454 B1 2/2001 Imai et al.
6,353,174 B1 * 3/2002 Schmidt et al. ..... 84/609
6,369,310 B1 * 4/2002 Brunson et al. ..... 84/600
6,441,291 B2 * 8/2002 Hasegawa et al. ..... 84/609
2002/0014147 A1 * 2/2002 Motoyama ..... 84/615

FOREIGN PATENT DOCUMENTS

EP 0855 697 7/1998
JP 10-257124 9/1998

* cited by examiner

*Primary Examiner*—Jeffrey W Donels
(74) *Attorney, Agent, or Firm*—Morrison & Foerster LLP

(57) ABSTRACT

An electronic musical apparatus such as an electronic musical instrument can be easily customized in accordance with a user's preference. Electronic musical instrument 20A and personal computers 40A, 40B can access server 50 via internet 10. A database that stores musical tone control data for controlling the generation of musical tone signals is provided in memory device 59 disposed in main body part 52 of server 50. Information on applicable apparatus types is annexed to the musical tone control data. At the time of purchasing electronic musical instruments 20A to 20C, the user is given a user identification data ID that can specify the apparatus types of electronic musical instruments 20A to 20C. With the use of this identification data ID, the user downloads the applicable musical tone control data from server 50 to electronic musical instrument 20A or to electronic musical instruments 20B, 20C via personal computers 40A, 40B.

24 Claims, 7 Drawing Sheets

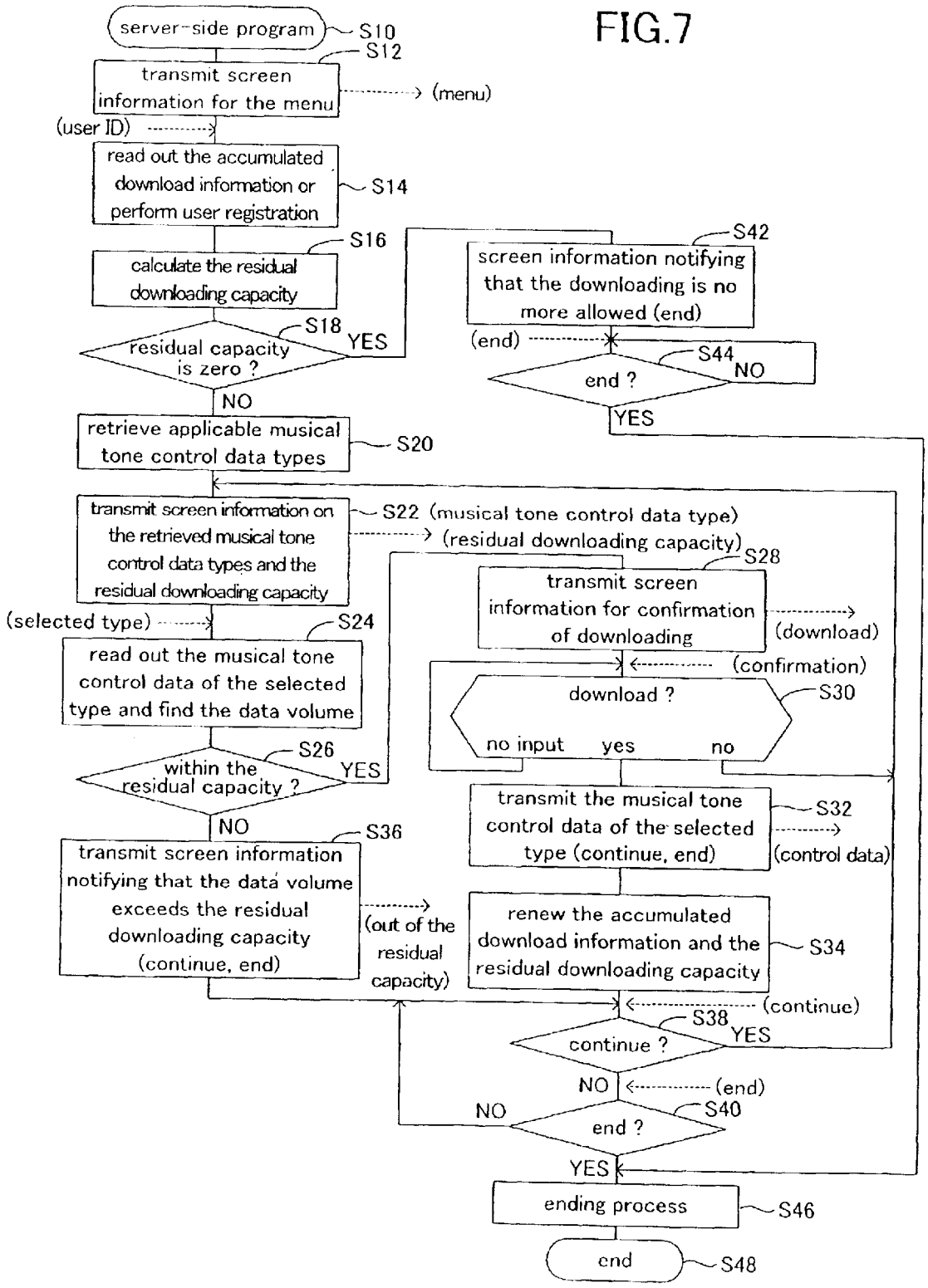
FIG.7
server-side program
S10
S12
transmit screen information for the menu
(menu)
(user ID)
read out the accumulated download information or perform user registration
S14
S16
calculate the residual downloading capacity
S18
residual capacity is zero ?
YES
NO
retrieve applicable musical tone control data types
S20
transmit screen information on the retrieved musical tone control data types and the residual downloading capacity
S22
(musical tone control data type)
(residual downloading capacity)
(selected type)
S24
read out the musical tone control data of the selected type and find the data volume
S26
within the residual capacity ?
YES
NO
S36
transmit screen information notifying that the data volume exceeds the residual downloading capacity (continue, end)
(out of the residual capacity)
S42
screen information notifying that the downloading is no more allowed (end)
(end)
S44
end ?
NO
YES
S28
transmit screen information for confirmation of downloading
(download)
(confirmation)
download ?
S30
no input
yes
no
transmit the musical tone control data of the selected type (continue, end)
S32
(control data)
renew the accumulated download information and the residual downloading capacity
S34
(continue)
S38
continue ?
YES
NO
(end)
NO
S40
end ?
YES
ending process
S46
end
S48

ELECTRONIC MUSICAL APPARATUS CUSTOMIZING METHOD

BACKGROUND OF THE INVENTION

1. Field of the Invention

The present invention relates to an electronic musical apparatus customizing method that customizes an electronic musical apparatus by providing musical tone control data for controlling the generation of musical tone signals from a server to the electronic musical apparatus that generates the musical tone signals, to an electronic musical apparatus that is applied to the method, and to a server for the electronic musical apparatus.

2. Description of the Background Art

Conventional electronic musical apparatus such as an electronic musical instrument often includes a musical tone signal generator that generates musical tone signals and a memory device that stores beforehand various musical tone control data that are supplied to the musical tone signal generator for controlling the generation of the musical tone signals, for example, various musical tone control data such as timbre data, effect data, automatic accompaniment data, and automatic play data. A user of the electronic musical apparatus may select desired musical tone control data to set the musical tone signals generated by the musical tone signal generator to a desired timbre, to impart a desired effect to the musical tone signals, and to allow generation of desired automatic accompaniment sounds, automatic play sounds, and the like from the musical tone signal generator.

Also, the user may prepare various musical tone control data such as timbre data, effect data, automatic accompaniment data, and automatic play data that the user desires by using a musical tone control data preparing function, a musical tone control data editing function, and others that are provided beforehand in the electronic musical apparatus, for storage in a memory device so that the user may use the prepared musical tone control data at the time of playing. Further, the user may connect the electronic musical apparatus to different electronic musical apparatus via a cable so as to store, in a memory device, the musical tone control data that are input from the different electronic musical apparatus, or may read the musical tone control data that are prepared in different electronic musical apparatus and recorded in a recording medium such as a flexible disk or a compact disk, for storage in a memory device.

However, in the aforesaid conventional electronic musical apparatus that uses only the musical tone control data stored beforehand in a memory device, desires of individual users may not be fully satisfied, since the memory device stores only the average musical tone control data that satisfy the desires of many users at an intermediate level. For example, a user that mainly plays or listens to Latin music may desire that the memory device stores beforehand numerous kinds of musical tone control data (timbre data, effect data, automatic accompaniment data, automatic play data, etc.) related to the Latin music; however, such desires may not be fully satisfied. Further, a beginner user may desire numerous kinds of automatic play data related to simple and easily understandable lesson music for practice; however, such desires of the user may not be fully satisfied, either. In contrast, if one wishes to satisfy the desires of all the users, a huge memory capacity is required in the memory device, and this is unrealistic.

Further, even in the aforesaid conventional electronic musical apparatus in which the users themselves prepare the musical tone control data, the musical tone control data cannot be easily prepared, and it is difficult to store numerous musical tone control data that suit the user's preference in a memory device. Further, even in an electronic musical apparatus that obtains musical tone control data from a different electronic musical apparatus or from a recording medium, it is not easy to find musical tone control data that are to be taken into the electronic musical apparatus and are suitable for the electronic musical apparatus, and in this case as well, it is difficult to store numerous musical tone control data that suit the electronic musical apparatus owned by the user and suit the user's preference in a memory device.

In order to solve these problems, one may prepare numerous kinds of electronic musical apparatus that are equipped with plural kinds of musical tone control data (timbre data, effect data, automatic accompaniment data, automatic play data) each made of a different combination for each region or country or in accordance with the user's preference. However, if this is adopted, one must manufacture numerous kinds of electronic musical apparatus that incorporate plural kinds of musical tone control data each made of a different combination, and also one must carry out the management of the stock and the like, thereby leading to cumbersome manufacture and management.

SUMMARY OF THE INVENTION

The present invention has been made in order to solve the aforementioned problems of the prior art, and an object thereof is to provide an electronic musical apparatus customizing method by which an electronic musical apparatus purchased by a user can be easily customized to suit the user's preference by allowing various musical tone control data that suit the electronic musical apparatus to be easily taken into a memory device from outside. The present invention also aims at providing an electronic musical apparatus that is applied to this electronic musical apparatus customizing method, and a server for the electronic musical apparatus.

In order to achieve the aforementioned object, the present invention relates to an electronic musical apparatus customizing method that is applied to an electronic musical apparatus comprising a musical tone signal generator for generating musical tone signals and a memory device capable of storing musical tone control data supplied to the musical tone signal generator for controlling generation of the musical tone signals. The electronic musical apparatus is customized in such a manner that desired musical tone control data to be stored into the memory device are supplied from a server having a database that stores various musical tone control data to be stored into the memory device and applicable to plural kinds of electronic musical apparatus, to a user side that uses the electronic musical apparatus so as to allow the supplied musical tone control data to be stored into the memory device on the user side. Further, the present invention is characterized in that, in accordance with identification information supplied from the user side and representing individual electronic musical apparatus, musical tone control data applicable to the electronic musical apparatus represented by the identification information are presented from the server to the user side; and musical tone control data belonging to the presented musical tone control data and selected by the user side are read out from the database, and the read-out musical tone control data are supplied from the server to the user side.

Viewed from another aspect, the present invention is characterized by the electronic musical apparatus to be customized and a server for realizing customization of an electronic musical apparatus. Further, in this specification, the term "electronic musical apparatus" widely refers to electronic apparatus that includes a musical tone signal generator for generating musical tone signals in accordance with musical tone control data and a memory device for storing the musical tone control data, and is used to include electronic musical instruments having a keyboard, electronic musical instruments without a keyboard, sequencers, personal computers, game apparatus, karaoke apparatus, and others.

In these cases, the information exchange between the user side and the server may be carried out via the internet. In order to use this internet, the first embodiment of the present invention is characterized in that the electronic musical apparatus further includes a communication interface circuit that allows information exchange with the server, whereby the information exchange between the server and the user side via the internet may be carried out with the use of the interface circuit, and the musical tone control data supplied from the server to the user side are directly downloaded into the memory device via the interface circuit.

On the other hand, the second embodiment of the present invention is characterized in that a computer apparatus for supplying to the electronic musical apparatus the musical tone control data to be supplied from the server to the user side is further provided on the user side, whereby the information exchange between the server and the user side via the internet, including the downloading of the musical tone control data supplied from the server to the user side, may be carried out with the use of the computer apparatus. In this second embodiment, an input circuit connected to the computer apparatus and capable of inputting the musical tone control data from the computer apparatus may be provided in the electronic musical apparatus, whereby the musical tone control data obtained from the server via the internet by the computer apparatus may be stored into the memory device via the input circuit. Further, a drive device that reads data recorded in a recording medium such as a flexible disk or a compact disk may be provided in the electronic musical apparatus, whereby the musical tone control data obtained from the server via the internet by the computer apparatus and recorded in the recording medium may be stored into the memory device via the drive device.

These allow that, even if the musical tone control data are not stored or only the average musical tone control data are stored in the memory device at the time of selling the electronic musical apparatus, musical tone control data especially desired by the user can be easily obtained from the server and can be stored into the memory device. Therefore, even without the use of a memory device having a large capacity, desires of individual users can be fully satisfied. For example, for a user that mainly plays or listens to Latin music or even for a beginner user, the musical tone control data desired by the user can be easily obtained, and the electronic musical apparatus can be customized as desired by the user, thereby satisfying various desires of the users. Further, there will be no need for preparing numerous kinds of electronic musical apparatus for each region or country or in accordance with the user's preference, thereby facilitating the manufacture and management of the electronic musical apparatus.

Furthermore, according to the present invention, the electronic musical instrument purchased by the user is specified in accordance with the identification information, and only the musical tone control data that suit each electronic musical apparatus are presented to the user, thereby avoiding a situation in which the musical tone control data that are not suitable are stored into the memory device. This leads to efficient use of the memory device.

Furthermore, another characteristic of the present invention lies in that a part of the musical tone control data is stored beforehand in the memory device at the time of manufacturing and purchasing the electronic musical apparatus, and the musical tone control data supplied from the server to the user side are additionally stored into the memory device. This leads to an advantage such that, even at the time of purchasing the electronic musical apparatus, at least the average musical tone signals can be generated.

Alternatively, in lieu of the aforementioned characteristic, the musical tone control data may not be stored beforehand in the memory device at the time of manufacturing and purchasing the electronic musical apparatus, and the musical tone control data supplied from the server to the user side may be stored into the memory device. This leads to an advantage such that the musical tone control data that are not needed by the user are not stored into the memory device, so that the capacity of the memory device can be restrained to the minimum.

Further, the present invention is characterized in that information representing a data amount of the musical tone control data supplied from the server to the user side is stored in the server in association with the identification information so that musical tone control data exceeding a predetermined amount will not be supplied to the user side. This prevents musical tone control data from being infinitely supplied from the server to the user side. This leads to an advantage such that, while satisfying the user's desires, one can avoid a disorderly supply of the musical tone control data from the server to the user side and can prevent the management and maintenance of the server from becoming complex.

BRIEF DESCRIPTION OF THE DRAWINGS

FIG. 7 is a flow chart of a server-side program executed in the server.

DESCRIPTION OF THE PREFERRED EMBODIMENTS

Figure 1:
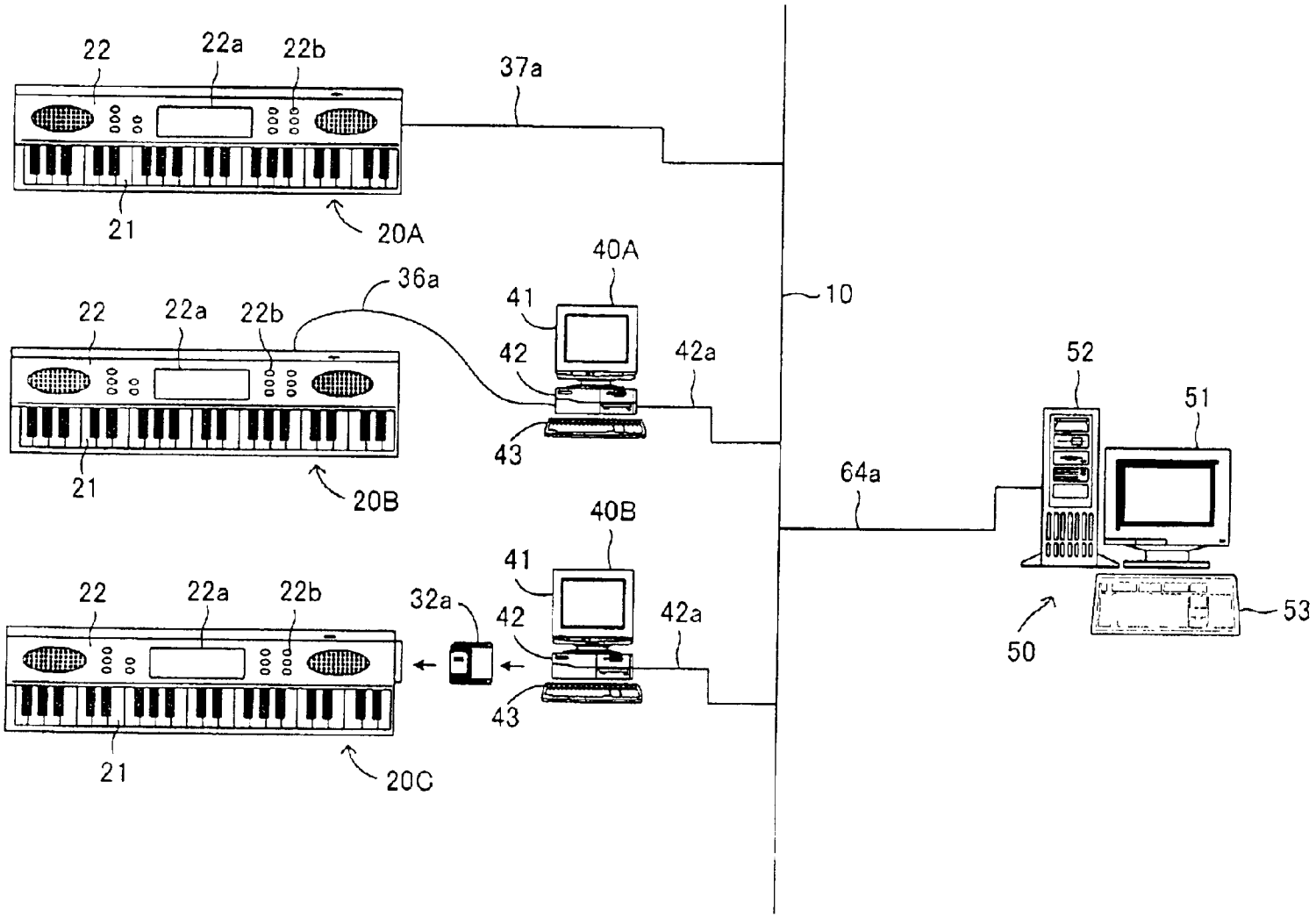
FIG. 1 is a schematic diagram illustrating a system for realizing customization of an electronic musical apparatus according to one embodiment of the present invention.

Hereafter, one embodiment of the present invention will be described with reference to the attached drawings. FIG. 1 is a view schematically illustrating a system that realizes the customization of an electronic musical apparatus according to the present invention.

This system includes an electronic musical instrument 20A serving as an electronic musical apparatus, personal computers 40A, 40B, and a server 50 that are connected to the internet 10. Here, FIG. 1 shows an example in which only one electronic musical instrument 20A and two personal computers 40A, 40B are connected to the internet 10; however, in actual cases, a large number of electronic musical instruments and personal computers are connected to the internet 10.

Figure 2:
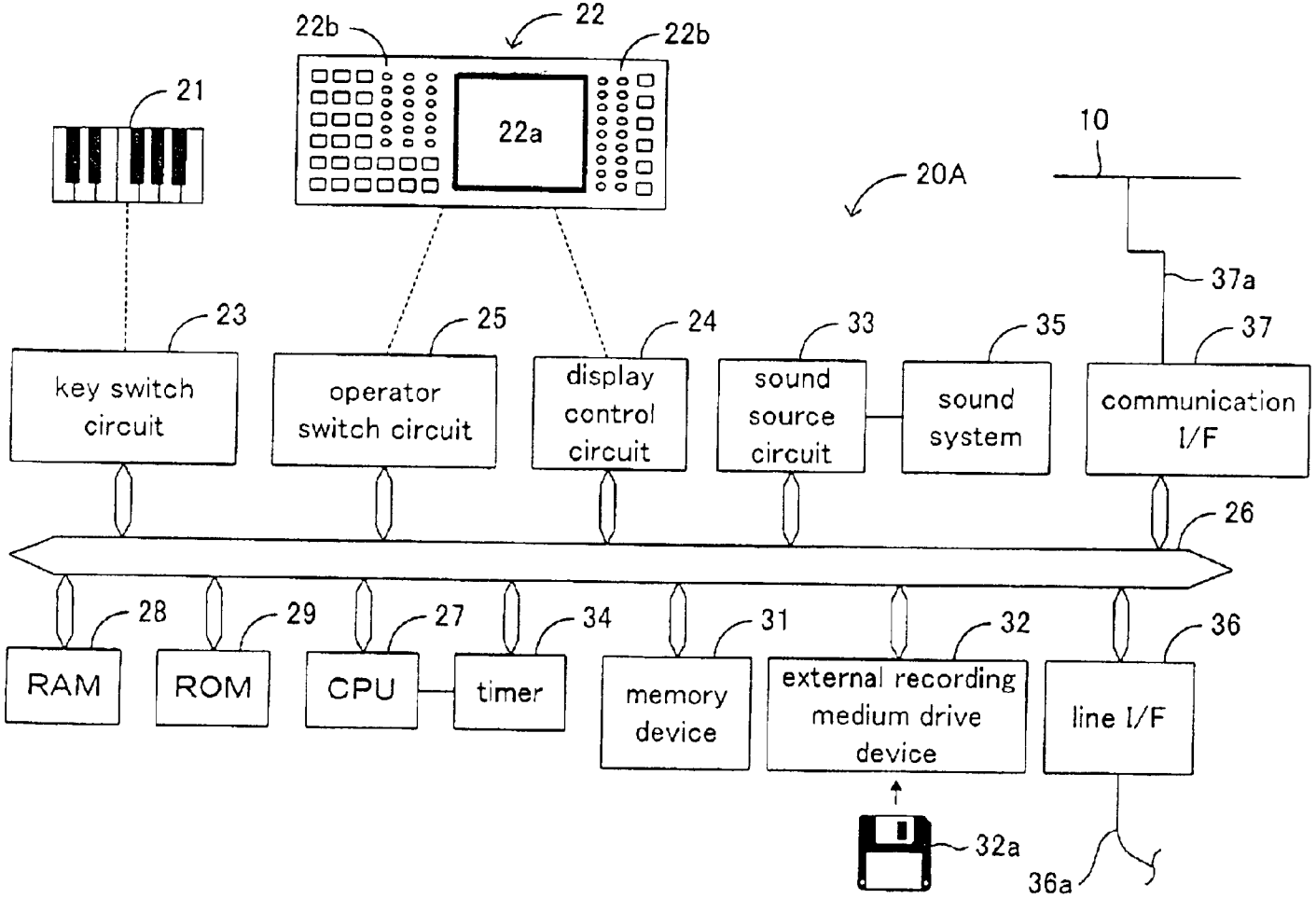
FIG. 2 is a schematic block diagram of an electronic musical instrument of FIG. 1.

Referring to FIG. 2, this electronic musical instrument 20A includes a keyboard 21 and an operation panel 22. Keyboard 21 is made of a plurality of keys as play operators, and pressing/depressing of each key is detected by a key switch disposed in correspondence with each key in a key switch circuit 23. A display 22*a* and a plurality of operators 22*b* are arranged on operation panel 22. Display 22*a* is constructed with a square-shaped liquid crystal displayer so as to be capable of displaying various images such as characters, numerals, and images. Here, as the display 22*a*, one may use other displayers such as a small cathode ray tube device different from liquid crystal displayers. Display of display 22*a* is controlled by a display control circuit 24. The plurality of operators 22*b* are for giving instructions on the operation of this electronic musical instrument, and are detected by operator switches disposed in respective correspondence with operators 22*b* in an operator switch circuit 25.

These key switch circuit 23, display control circuit 24, and operator switch circuit 25 are connected to a bus 26. Further, a CPU 27, a RAM 28, a ROM 29, a memory device 31, an external recording medium drive device 32, and a sound source circuit 33 are connected to bus 26. CPU 27 executes the musical instrument side program of FIG. 6 to obtain musical tone control data (later described in detail) from server 50 via internet 10, and executes other programs to control various operations of the electronic musical instrument. A timer 34 connected also to bus 26 is connected to this CPU 27, and timer 34 measures time to control execution and the like of programs by CPU 27. RAM 28 stores a part or a whole of various programs transferred from memory device 31 in accordance with the needs, and temporarily stores variables needed for the execution of the programs. ROM 29 stores a part of various programs.

Memory device 31 is constructed with a recording medium having a large capacity such as a hard disk HD, and stores a part or a whole of various programs and musical tone control data that control the generation of musical tone signals. Here, this memory device 31 also includes a drive device that enables reading of the programs and data recorded in a recording medium such as a hard disk HD and writing of the programs and data into the aforesaid recording medium.

Figure 4:
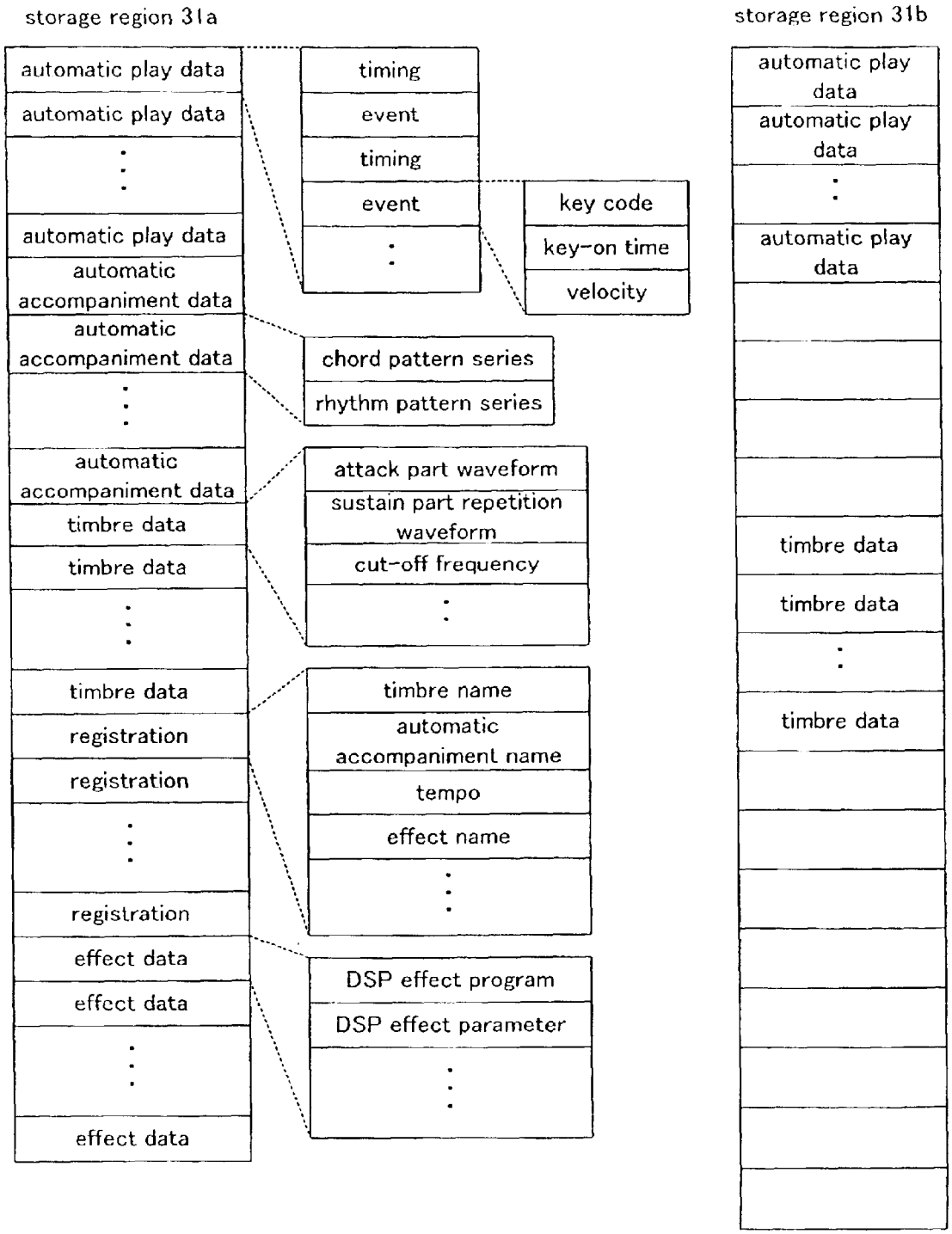
FIG. 4 is a data format diagram of a storage region for storing musical tone control data which region is disposed in a memory device of the electronic musical instrument.

Now, the musical tone control data that are stored in memory device 31 and control the generation of musical tone signals will be hereafter described in detail. In order to store the musical tone control data, storage regions 31*a*, 31*b* such as illustrated in FIG. 4 are disposed in memory device 31. Storage region 31*a* is a region for storing the musical tone control data in advance, and already stores the musical tone control data at the time of shipping the electronic musical instrument 20A. The musical tone control data are made, for example, of respectively plural sets of automatic play data, automatic accompaniment data, timbre data, registration data, effect data, and others.

A set of automatic play data are made of numerous event data made of key codes, key-on time, velocity, and others and representing events that follow the passage of time as well as timing data representing the time intervals between the events, and are play data for allowing automatic play of one piece of music. A set of automatic accompaniment data are made of chord pattern series and rhythm pattern series respectively representing chord sound series and percussion instrument sound series for one bar or plural bars that follow the passage of time, so as to control the generation of accompaniment sounds and rhythm sounds respectively corresponding to music genres such as rock music and marches. A set of timbre data are made of attack part waveform data representing the attack part waveforms, sustain part repetition waveform data representing the repetition waveforms of sustain parts, cut-off frequency data representing the cut-off frequency of a filter, and others, so as to control the timbre of the musical tones that are generated. A set of registration data are made of a combination of timbre name data, automatic accompaniment name data, tempo data, effect name data, and others respectively representing the selected timbre, automatic accompaniment, tempo, effect, and others, so as to simultaneously control plural kinds of modes of the musical tones that are generated. A set of effect data are made of DSP (digital signal processor) effect programs, DSP effect parameters, and others, so as to control the effects imparted to the musical tone signals that are generated.

Storage region 31*b* is a region for storing musical tone control data that are downloaded from server 50, and does not store the musical tone control data at the time of selling the electronic musical instrument 20A. The musical tone control data are selected by a user from among the aforementioned respectively plural sets of automatic play data, automatic accompaniment data, timbre data, registration data, effect data, and others.

External recording medium drive device 32 enables reading of programs and data recorded in various external recording media 32*a* such as a compact disk CD, a mini disk MD, or a flexible disk FD and writing of the programs and data into the aforesaid external recording media 32*a*.

Sound source circuit 33 constitutes a musical tone signal generator, and forms musical tone signals in accordance with the play information (key-on signal, key-off signal, note number, velocity, etc.) from CPU 27. In forming the musical tone signals, the mode of generating the musical tones including the musical tone elements such as the timbre, tone volume (amplitude envelope), and effect of the musical tone signals is controlled by the musical tone control data supplied from CPU 27 to sound source circuit 33. Further, sound source circuit 33 includes an effect circuit made of DSP (digital signal processor) for imparting an effect to the generated musical tone signals. The musical tone signals generated from sound source circuit 33 are output to a sound system 35. Sound system 35 is made of amplifiers, speakers, and others, so as to generate the musical tones corresponding to the aforesaid output musical tone signals.

Further, a line interface circuit 36 and a communication interface circuit 37 are also connected to bus 26. Line interface circuit 36 is for exchanging various programs and data with other electronic musical instruments, personal computers, various musical apparatus, and others via a cable 36*a*. Here, this line interface circuit 36 is typically constructed with an input circuit for inputting MIDI data constituting the musical tone control data and an output circuit for outputting the MIDI data. Communication interface circuit 37 is connectable to various outside apparatus via a communication line 37*a* such as a telephone line and via internet 10. In this embodiment, communication interface circuit 37 is connected to server 50 via communication lines 37*a*, 64*a* such as a telephone line and an exclusive-use line and via internet 10. Here, in the mode of use in the system of FIG. 1, other electronic apparatus are not connected to line interface circuit 36 of electronic musical instrument 20A.

Personal computers 40A, 40B are ordinary commercially available ones made of a display device 41, a main body part 42, and a keyboard 43. In the present embodiment, personal computer 40A at main body part 42 is connected to internet 10 via communication line 42*a* and is connected to line interface circuit 36 of electronic musical instrument 20B via cable 36*a*. Therefore, electronic musical instrument 20B is constructed almost in the same manner as the aforementioned electronic musical instrument 20A and necessarily includes line interface circuit 36, but need not necessarily include communication interface circuit 37 and external recording medium drive device 32.

Further, personal computer 40B at main body part 42 is connected to internet 10 via communication line 42*a*, but is not connected to the electronic musical instrument via a cable or the like. In this case, personal computer 40B is used for writing data into external recording medium 32*a* via the drive device incorporated in main body part 42 so as to allow the data to be taken into electronic musical instrument 20C. Therefore, electronic musical instrument 20C is constructed almost in the same manner as the aforementioned electronic musical instrument 20A and necessarily includes external recording medium drive device 32, but need not necessarily include communication interface circuit 37 and line interface circuit 36.

Figure 3:
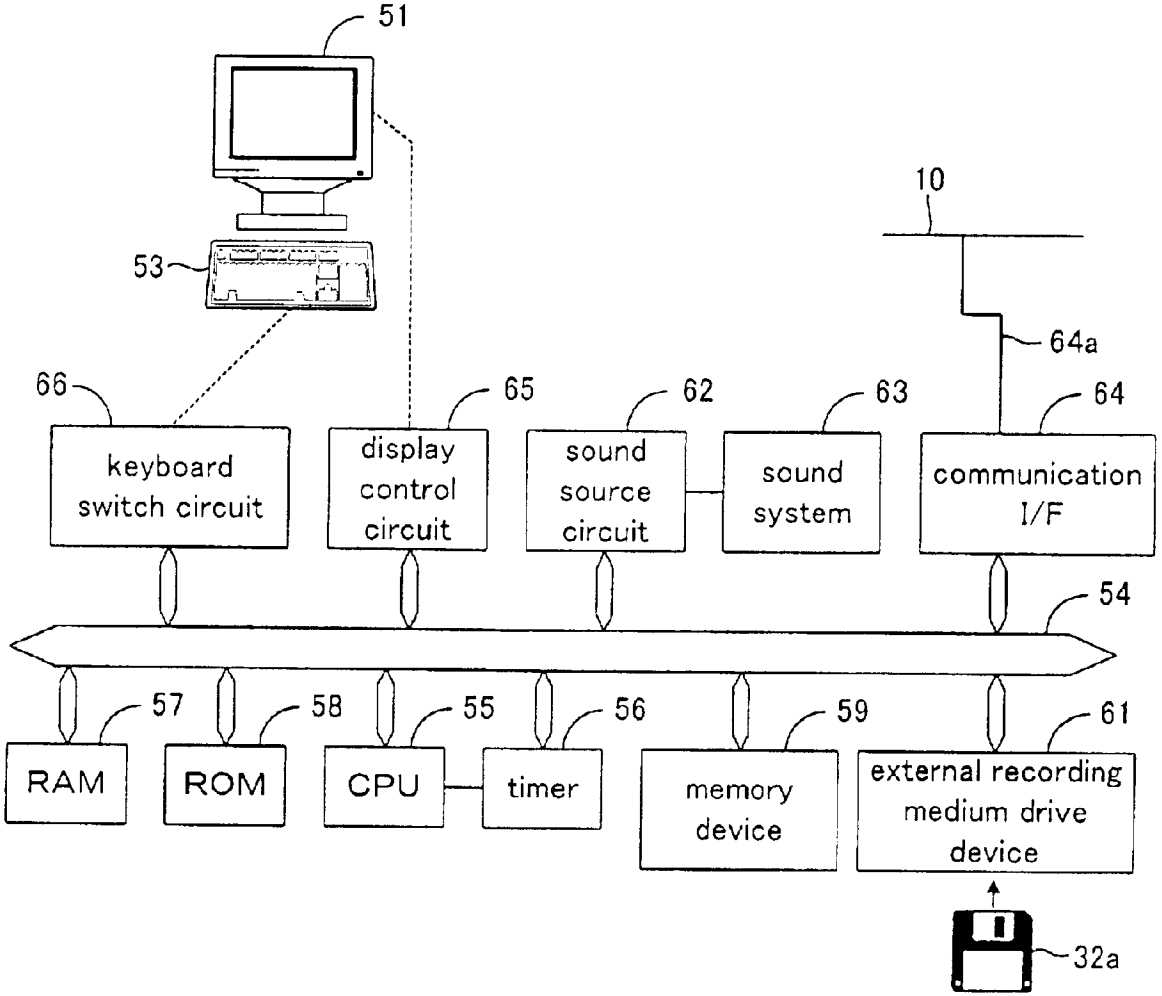
FIG. 3 is a schematic block diagram of a server of FIG. 1.

Server 50 is also constructed with a computer apparatus made of a display device 51, a main body part 52, and a keyboard 53, and is prepared by the manufacturer. Referring to FIG. 3, main body part 52 includes a CPU 55, a timer 56, a RAM 57, a ROM 58, a memory device 59, an external recording medium drive device 61, a sound source circuit 62, a sound system 63, a communication interface circuit 64, and a display control circuit 65 that are connected to a bus 54. These circuit devices are constructed almost in the same manner as in the aforesaid electronic musical instruments 20A, 20B, 20C, but memory device 59 stores a server-side program shown in FIG. 7, whereby CPU 55 executes the program to transmit the musical tone control data to electronic musical instrument 20A and to personal computers 40A, 40B via internet 10. Further, in this server 50, operation of each operator in keyboard 53 is detected by a switch disposed in respective correspondence with each keyboard operator in a keyboard switch circuit 66.

Figure 5:
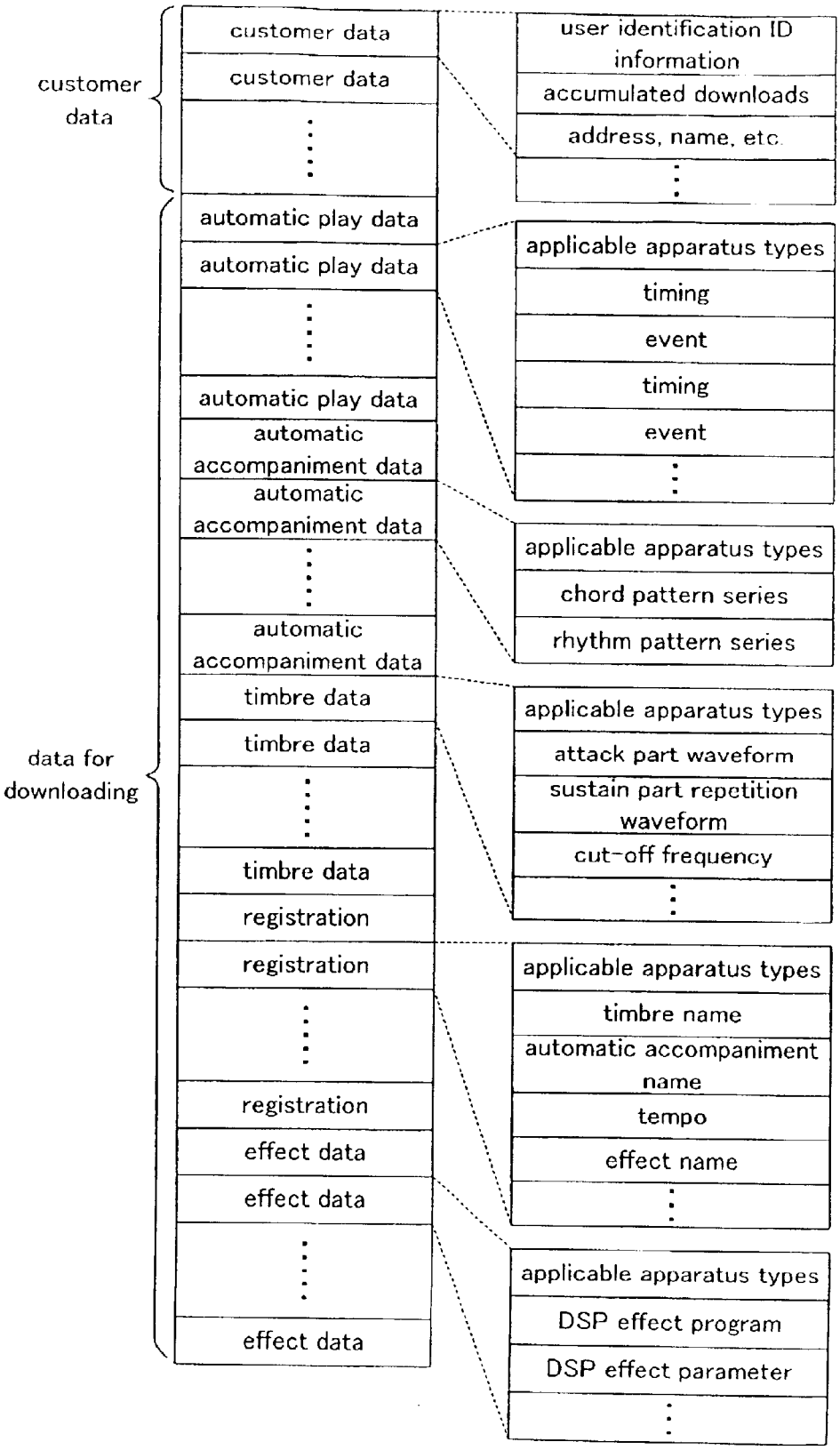
FIG. 5 is a data format diagram of a database disposed in a memory device of the server.

Further, memory device 59 is provided with a database for storing numerous sets of musical tone control data that are applicable to numerous kinds of electronic musical instruments (numerous types of apparatus) manufactured by the manufacturer and are supplied to the user side. Referring to FIG. 5, the musical tone control data are similar to the previously described one made of automatic play data, automatic accompaniment data, timbre data, registration data, effect data, and others; however, applicable apparatus type data representing the type names of applicable electronic musical instruments are respectively attached to each of the musical tone control data. In this case, if applicable apparatus types are present in a large number, the database stores applicable apparatus type data representing all the types of applicable apparatus. The manufacturer at the time of selling a new apparatus type renews the database with the musical tone control data that are related to the new apparatus type.

Further, in addition to the aforesaid musical tone control data, the database stores a plurality of customer data. Each of the customer data is made of a user identification data ID, accumulated download data, address data, name data, and others. The user identification data ID is given for each purchaser of an electronic musical instrument, i.e. for each user, at the time of purchasing the electronic musical instrument. Further, this user identification data ID directly or indirectly includes apparatus type data representing the type (apparatus type) of the electronic musical instrument that the user has purchased. A manufacture number (product number) of the electronic musical instrument can be used as the user identification data ID. The accumulated download data represent the data amount of the musical tone control data downloaded into electronic musical instruments 20A, 20B, 20C of the user. The address data represent the address of the user, and the name data represent the name of the user.

Hereafter, with the use of the system according to the embodiment constructed as shown above, the procedures for customizing the electronic musical instrument and the specific operations of customizing the electric musical instrument will be described.

First, a user obtains user identification data ID from a shop clerk at the time of purchasing an electronic musical instrument at a shop or the like. Then, the user determines whether the user wishes to download the aforesaid musical tone control data into the electronic musical instrument directly or via a personal computer. Further, even in the case of downloading the musical tone control data via a personal computer, the user determines whether the user wishes to supply the musical tone control data, which are downloaded into the personal computer, into the electronic musical instrument via a cable or via an external recording medium. These selections, though depending on the user's preference, also depend on whether or not the purchased electronic musical instrument is equipped with communication interface circuit 37, line interface circuit 36, and external recording medium drive device 32 that are shown in FIG. 2. Nevertheless, the user can order the shop to download the musical tone control data into the electronic musical instrument.

In the case of directly downloading the musical tone control data into an electronic musical instrument, the user or shop clerk connects electronic musical instrument 20A directly to internet 10 via communication line 37*a*, as illustrated in the top part of FIG. 1. Then, the user or shop clerk directly downloads the musical tone control data that the user wishes, from server 50 into storage region 31*b* in memory device 31 of electronic musical instrument 20A by operating operators 22*b* while looking at display 22*a* of electronic musical instrument 20A.

In the case of supplying the musical tone control data, which are downloaded into a personal computer, to an electronic musical instrument via a cable, the user or shop clerk connects electronic musical instrument 20B via cable 36*a* to personal computer 40A that is connected to communication line 42*a*, as illustrated in the middle part of FIG. 1. Then, the user or shop clerk temporarily downloads the musical tone control data that the user wishes, from server 50 into personal computer 40A by operating keyboard 43 while looking at display device 41 of personal computer 40A. Thereafter, the aforesaid musical tone control data downloaded into computer 40A are written into storage region 31*b* in memory device 31 of electronic musical instrument 20B via cable 36*a* by operating keyboard 43 of personal computer 40A and operators 22*b* of electronic musical instrument 20B.

In the case of supplying the musical tone control data, which are downloaded into a personal computer, to an electronic musical instrument via an external recording medium, the user or shop clerk temporarily downloads the musical tone control data that the user wishes, from server 50 into personal computer 40B by operating keyboard 43 while looking at display device 41 of personal computer 40B connected to communication line 42*a*, as illustrated in the bottom part of FIG. 1. Then, the aforesaid downloaded musical tone control data are written into external recording medium 32*a*. Thereafter, external recording medium 32*a* having the musical tone control data written therein is set into external recording medium drive device 32 of electronic musical instrument 20C and, by operation of operators 22*b*, the musical tone control data written in external recording medium 32*a* are read out and written into memory device 31.

Such an operation of downloading the musical tone control data into electronic musical instrument 20A and an operation of downloading the musical tone control data into personal computers 40A, 40B will be described with reference to the user-side program of FIG. 6 and the server-side program of FIG. 7. Here, since the above-mentioned three types of downloading operations are almost the same, each downloading operation will be described in common and, for the sake of descriptions, the downloading operation carried out by a shop clerk will be assumed as being the same as the downloading operation carried out by the user.

Figure 6:
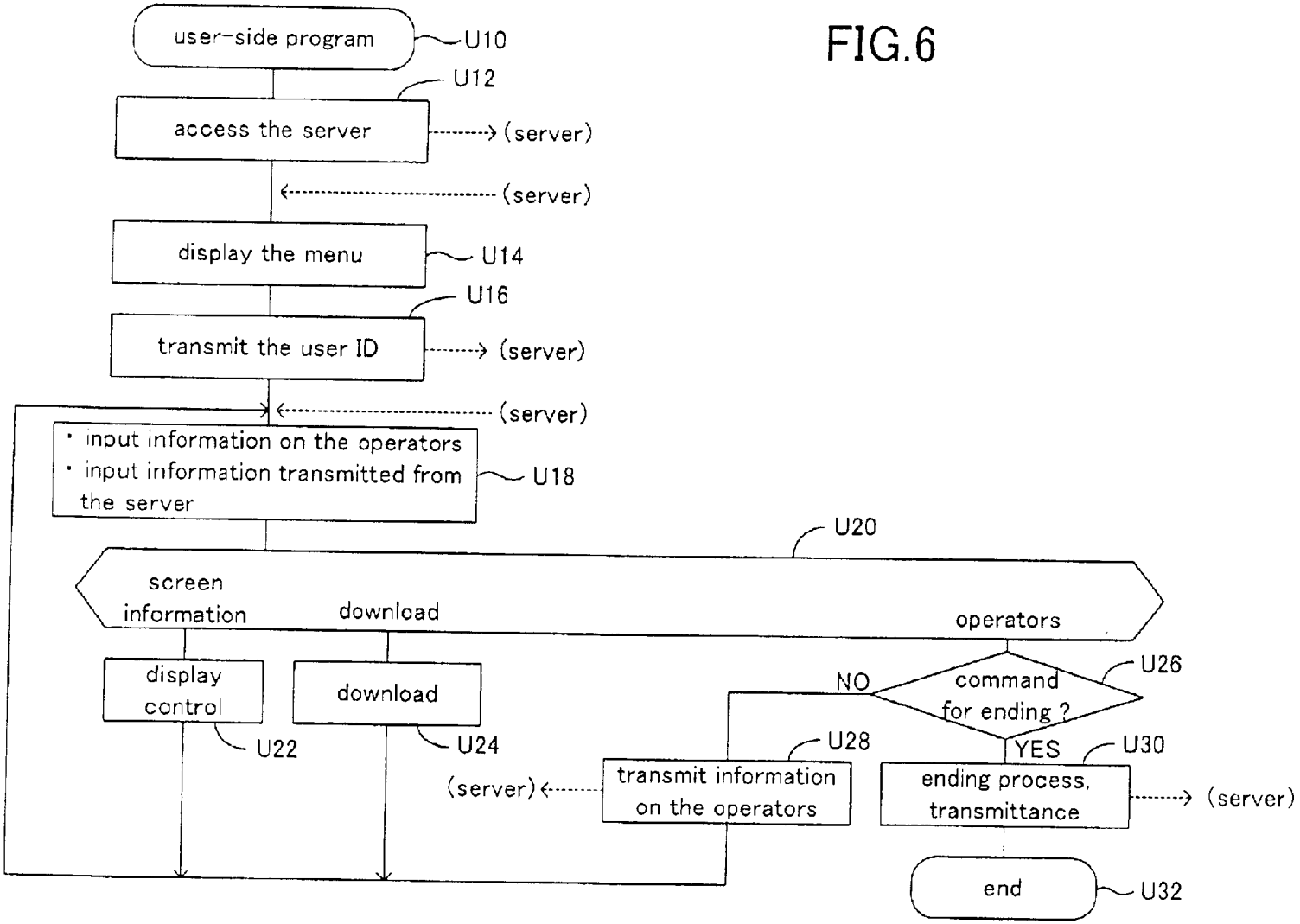
FIG. 6 is a flow chart of a user-side program executed in the electronic musical instrument and in a personal computer.

In downloading the musical tone control data, the user allows the user-side program of FIG. 6 to be executed by operating operators 22*b* of electronic musical instrument 20A or keyboard 43 of personal computers 40A, 40B in accordance with instructions given by display 22*a* of electronic musical instrument 20A or display device 41 of personal computer 40A, 40B. First, the execution of the user-side program is started in step U10, and the user makes access to server 50 in step U12.

Meanwhile, in response to the aforesaid access, server 50 starts execution of the server-side program in step S10 of FIG. 7, and transmits a menu screen data to electronic musical instrument 20A or to personal computer 40A, 40B in step S12. Electronic musical instrument 20A or personal computer 40A, 40B receives the aforesaid transmitted menu screen data, and displays a menu screen corresponding to the aforesaid received menu screen data on display 22*a* or on display device 41 in step U14. This menu screen includes an instruction for inputting a user identification data ID. When the user inputs the user identification data ID obtained at the time of purchasing the aforesaid electronic musical instrument with the use of operators 22*b* or keyboard 43, electronic musical instrument 20A or personal computer 40A, 40B transmits the aforesaid input user identification data ID in step U16. Here, in the case where the user makes access to server 50 for the first time after purchasing the electronic musical instrument, input of the user's address, name, etc. is also requested, and the data representing the user's input address, name, etc. are also transmitted to server 50 together with the aforesaid user identification data ID.

In response to this transmission of the user identification data ID, server 50 reads out the accumulated download data stored in the database in memory device 59 and corresponding to the user identification data ID in step S14. Further, when the user makes access to server 50 for the first time after purchasing the electronic musical instrument as described above, user registration is made by storing the user identification data ID, the address data, the name data, and others transmitted to the database.

After the aforesaid process of step S14, server 50 calculates a residual downloading capacity that is allowed hereafter to the user represented by the user identification data ID on the basis of the aforesaid read-out accumulated download data in step S16. Specifically, the amount represented by the aforesaid read-out accumulated download data is subtracted from the total downloading capacity that is determined in advance for the user, so as to calculate the residual downloading capacity. Here, if the user registration is made as described above, the total downloading capacity determined in advance is assumed to be the residual downloading capacity, since the amount represented by the accumulated download data is zero.

After the aforesaid process of step S16, server 50 determines whether the aforesaid calculated residual downloading capacity is zero or not in step S18. If the residual downloading capacity is not zero, server 50 determines as "YES" in step S18 and proceeds to step S20. In step S20, with the use of the user identification data ID, server 50 retrieves the types of musical tone control data (for examples, types of automatic play data, automatic accompaniment data, timbre data, etc.) that are applicable to the type of the electronic musical instrument specified by the user identification data ID, from among the musical tone control data stored in the database in memory device 59. Then, in step S22, server 50 transmits the aforesaid retrieved musical tone control data and screen information representing the aforesaid calculated residual downloading capacity to electronic musical instrument 20A or personal computer 40A, 40B.

Meanwhile, in electronic musical instrument 20A or in personal computer 40A, 40B, after the process of step S16, a circulation process made of steps U18 to U28 is being executed. In step U18, operation of operators 22*b* of electronic musical instrument 20A or keyboard 43 of personal computer 40A, 40B and transmission of data from server 50 are awaited. Step U20 is a process of determining whether information has been transmitted from server 50 or operation of operators 22*b* or keyboard 43 has been made. Further, this determining process of step U20 also determines whether the information transmitted from server 50 is screen information or musical tone control data to be downloaded.

Step U22 is a process of controlling display 22*a* or display device 41 on the basis of the screen information transmitted from server 50. Step U24 is a process of downloading the musical tone control data transmitted from server 50 into storage region 31*b* in memory device 31 of electronic musical instrument 20A or into the memory device disposed in main body part 42 of personal computer 40A, 40B. Step U26 is a process of determining an ending instruction given by the user with the use of operators 22*b* or keyboard 43. Step U28 is a process of transmitting information on the operation of operators 22*b* or keyboard 43 to server 50.

If screen information is transmitted from server 50 as described above, electronic musical instrument 20A or personal computer 40A, 40B inputs the aforesaid screen information in step U18, and proceeds to step U22 by the determining process of step U20. In step U22, display of display 22*a* or display device 41 is controlled on the basis of the aforesaid screen information transmitted from server 50. In other words, the types of musical tone control data applicable to the electronic musical instrument specified by the user identification data ID and the residual downloading capacity for the electronic musical instrument are displayed on display 22*a* or on display device 41.

The user selects musical tone control data by operating operators 22*b* or keyboard 43 while looking at display 22*a* or display device 41. In response to this operation, electronic musical instrument 20A or personal computer 40A, 40B proceeds to step U26 by the processes of steps U18, U20. In this case, since the operation of operators 22*b* or keyboard 43 is an instruction for selecting musical tone control data and is not an instruction for ending, electronic musical instrument 20A or personal computer 40A, 40B determines as "NO" in step U26 to proceed to step U28. In step U28, electronic musical instrument 20A or personal computer 40A, 40B transmits information on the operation of operators 22*b* or keyboard 43, i.e. information representing the type of the selected musical tone control data, to server 50.

In response to this transmission of the information representing the selected type of musical tone control data, server 50 in step S24 reads out the musical tone control data corresponding to the selected type from the database in memory device 59, and senses the data amount of the read-out musical tone control data. Then, in step S26, server 50 compares the sensed data amount with the residual downloading capacity calculated in the aforesaid process of step S16 to determine whether the data amount of the musical tone control data selected by the user is within the residual downloading capacity or not. If this determination turns out to be "YES", i.e. if the data amount of the selected musical tone control data is within the residual downloading capacity, server 50 in step S28 transmits screen information representing the confirmation on whether or not to download the selected musical tone control data.

On the other hand, electronic musical instrument 20A or personal computer 40A, 40B inputs the aforesaid transmitted screen information in step U18, and displays a screen for confirmation of downloading on display 22*a* of electronic musical instrument 20A or on display device 41 of personal computer 40A, 40B by the processes of steps U20, U22. When the user inputs confirmation on whether or not to download by operating operators 22*b* or keyboard 43, information on the confirmation is transmitted to server 50 by the processes of steps U18, U20, U26, U28.

Meanwhile, after the aforesaid process of step S28, server 50 waits for the receipt of the aforesaid information on confirmation in step S30. If the information on confirmation is not received, server 50 determines as "no input" in step S30 to continue the determining process of step S30. If the received information on confirmation is "no download", server 50 executes the processes of step S22 and onwards again. If the received information on confirmation is "download", server 50 in step S32 transmits the musical tone control data that are of the type selected by the user and read out from the database in memory device 52 by the aforesaid process of step S24, to electronic musical instrument 20A or personal computer 40A, 40B. After this transmission, server 50 in step 34 renews the accumulated download information stored in the database and specified by the user identification data ID by increasing the accumulated downloads for the data amount of the aforesaid downloaded musical tone control data. Further, server 50 in step S34 renews the residual downloading capacity calculated by the aforesaid process of step S16 by decreasing the downloading capacity for the data amount of the aforesaid downloaded musical tone control data.

In this way, when the selected musical tone control data are transmitted from server 50 to electronic musical instrument 20A or to personal computer 40A, 40B, electronic musical instrument 20A or personal computer 40A, 40B downloads the aforesaid transmitted musical tone control data into storage region 31*b* of memory device 31 or into the memory device in main body part 42 by the processes of steps U18, U20, U24.

Further, at the time of transmitting the musical tone control data by server 50 in step S32, server 50 also transmits screen information representing the "continuance of operation and ending of operation" to electronic musical instrument 20A or personal computer 40A, 40B. Furthermore, after the aforesaid process of step S34, server 50 waits for an input of information on an instruction for continuance of operation or ending of operation from electronic musical instrument 20A or personal computer 40A, 40B in steps S38, S40. If neither the information on an instruction for continuance of operation nor the information on an instruction for ending of operation is input, server 50 determines as "NO" in both of the steps S38, S40 and repeats the circulation process of steps S38, S40.

On the other hand, electronic musical instrument 20A or personal computer 40A, 40B displays instructions for continuance of operation and for ending of operation on display 22*a* or on display device 41 by the processes of steps U18 to U22. In this case, if the user gives an instruction for continuance of operation by using operators 22*b* or keyboard 43, the operation information is transmitted to server 50 by the processes of steps U18, U20, U26, U28. When information on the instruction for continuance of operation is transmitted to server 50 in this way, server 50 determines as "YES", i.e. continuance of operation, in step S38, and returns to step S22. Therefore, in this case, by the above-described processes of step S22 and onwards, musical tone control data newly selected by the user can be downloaded into electronic musical instrument 20A or personal computer 40A, 40B.

On the other hand, if the user gives an instruction for ending of operation by using operators 22*b* or keyboard 43, electronic musical instrument 20A or personal computer 40A, 40B determines as "YES" in step U26 after the aforesaid processes of steps U18, U20, and executes an ending process in step U30 to end the execution of the user-side program in step U32. Further, in the aforesaid step U30, operation information representing the ending of operation is also transmitted to server 50. In this case, server 50 determines as "YES" in step S40, and executes an ending process in step S46 to end the execution of the server-side program in step S48.

Further, if server 50 determines as "NO" in step S26, namely, if it is determined that the data amount of the selected musical tone control data is not within the residual downloading capacity, the server 50 proceeds to step S36. In step S36, screen information indicating that the musical tone control data selected by the user exceeds the residual downloading capacity is transmitted to electronic musical instrument 20A or personal computer 40A, 40B. Furthermore, in this step S36, screen information representing the "continuance of operation and ending of operation" is also transmitted to electronic musical instrument 20A or personal computer 40A, 40B in the same manner as in the case of the aforesaid step S32.

By transmission of such screen information, electronic musical instrument 20A or personal computer 40A, 40B by the processes of steps U18 to U22 displays on display 22*a* or on display device 41 that the musical tone control data selected by the user exceed the residual downloading capacity, and also displays a request for input of an instruction for continuance of operation and ending of operation. Then, if the user gives an instruction for continuance of operation by operating operators 22*b* or keyboard 43, the user's work of selecting musical tone control data is continued by the aforesaid determining process of server 50 in step S38. On the other hand, if the user gives an instruction for ending of operation, the execution of the user-side program is ended by the aforesaid processes of steps U26, U30, U32 in electronic musical instrument 20A or personal computer 40A, 40B, while the execution of the server-side program is ended by the aforesaid processes of steps S40, S46, S48 in server 50.

Further, in server 50, if the residual downloading capacity calculated by the aforesaid process of step S16 is zero and it is determined as "YES" in step S18, server 50 proceeds to step S42. In step S42, screen information indicating that the downloading of musical tone control data is not possible is transmitted to electronic musical instrument 20A or personal computer 40A, 40B. Further, in this step S42, screen information representing the "ending of operation" is also transmitted to electronic musical instrument 20A or personal computer 40A, 40B.

By transmission of such screen information, electronic musical instrument 20A or personal computer 40A, 40B by the processes of steps U18 to U22 displays on display 22*a* or on display device 41 that the downloading of musical tone control data is not possible, and also displays a request for input of an instruction for ending of operation. This lets the user recognize that the musical tone control data cannot be downloaded into electronic musical instrument 20A or personal computer 40A, 40B any more. Then, if the user gives an instruction for ending of operation by operating operators 22*b* or keyboard 43, the execution of the user-side program is ended by the aforesaid processes of steps U18, U20, U26, U30, U32 in electronic musical instrument 20A or personal computer 40A, 40B. Meanwhile, server 50 determines as "YES" in step S44 by receipt of information representing an instruction for ending, and the execution of the server-side program is ended by the aforesaid processes of steps S46, S48.

As described above, in the case where electronic musical instrument 20A is directly connected to internet 10 via communication line 37*a* (top part of FIG. 1), the musical tone control data desired by the user can be directly downloaded into storage region 31*b* of memory device 31 of electronic musical instrument 20A. Further, with the use of the downloaded musical tone control data, the musical tone signals generated in sound source circuit 33 can be controlled by execution of a program (not illustrated). Specifically, in the case of automatic play data, music desired by the user can be automatically played. In the case of automatic accompaniment data, desired accompaniment sounds can be added to the playing of the user using keyboard 21. In the case of timbre data, the timbre of the musical tone signals formed in sound source circuit 33 can be controlled to a desired timbre. In the case of effect data, desired effects can be added to the musical tone signals formed in sound source circuit 33. Further, in the case of registration data, musical tones generated from electronic musical instrument 20A can be comprehensively controlled.

In the case where personal computer 40A, 40B is connected to internet 10 via communication line 42*a* (middle and bottom parts of FIG. 1), the musical tone control data desired by the user are temporarily downloaded into personal computer 40A, 40B. Then, in this case, electronic musical instrument 20B is connected to personal computer 40A via cable 36*a* so that the aforesaid musical tone control data downloaded in personal computer 40A are written into storage region 31*b* of memory device 31 of electronic musical instrument 20B via cable 36*a*. On the other hand, in the case shown by the bottom part of FIG. 1, the aforesaid musical tone control data downloaded in personal computer 40B are supplied to electronic musical instrument 20C via external recording medium 32*a* and written into storage region 31*b* of memory device 31 of electronic musical instrument 20B. Therefore, even in these cases, the musical tone signals generated in sound source circuit 33 can be controlled with the desired musical tone control data by execution of a program (not illustrated).

As a result of this, according to the above-described embodiments, even if only the average musical tone control data are stored in memory device 31 at the time of selling electronic musical instruments 20A to 20C, musical tone control data especially desired by the user can be easily obtained from server 50 and can be stored into memory device 31. Therefore, even without the use of a memory device having a large capacity as memory device 31, desires of individual users can be fully satisfied. For example, for a user that mainly plays or listens to Latin music or even for a beginner user, the musical tone control data desired by the user can be easily obtained, and electronic musical instruments 20A to 20C can be customized as desired by the user, thereby satisfying various desires of the users. Further, there will be no need for preparing numerous kinds of electronic musical apparatus for each region or country or in accordance with the user's preference, thereby facilitating the manufacture and management of the electronic musical apparatus.

Furthermore, the type of the electronic musical instrument purchased by the user is specified in accordance with the user identification data ID information, and only the musical tone control data that suit each electronic musical instrument are presented to the user, thereby avoiding a situation in which the musical tone control data that are not suitable for electronic musical instruments 20A to 20C owned by the user are stored into memory device 31. This leads to efficient use of memory device 31. Furthermore, average musical tone control data are stored beforehand in storage region 31*a* of memory device 31, so that at least the average musical tone signals can be generated and controlled even before downloading the aforesaid musical tone control data.

In addition, in the above-described embodiments, accumulated download information is stored in association with the user identification data ID in the database in memory device 59 of server 50 and, by the processes of steps S16, S18 using this accumulated download information, musical tone control data that exceed a predetermined amount are prevented from being supplied to the user side. Therefore, musical tone control data are prevented from being infinitely supplied from server 50 to the user side. This leads to an advantage such that, while satisfying the user's desires, one can avoid a disorderly supply of the musical tone control data from server 50 to the user side and can prevent the management and maintenance of server 50 from becoming complex.

Here, in the above-described embodiments, a manufacture number (product number) of an electronic musical instrument is used as the user identification data ID. However, a media access control address (MAC address), which is assigned to a LAN card or a LAN board as a native identification data, can be also used as the user identification data ID. A user has to associate the media access control address with the user's electronic musical instrument on the basis of a web screen, an application program, etc., in case the media access control address is not associated with the user's electronic musical instrument, for example, in such a case that the electronic musical instrument is connected to a network via a personal computer by the user.

Further, in the above-described embodiments, data representing the accumulated data amount of the musical tone control data supplied from server 50 to the user are adopted as the accumulated download information. However, as this accumulated download information, one can adopt information indirectly representing the accumulated data amount of the musical tone control data supplied to the user. For example, the accumulated download information may be a value obtained by subtracting the amount of the aforesaid downloaded musical tone control data from a total downloading capacity determined in advance. In this case, the downloaded data amount is subtracted from the stored capacity in step S34 of FIG. 7, and the calculation of residual downloading capacity in step S16 is not needed. Further, the number of the types of musical tone control data may be adopted in place of the musical tone control data amount.

Further, in the above-described embodiments, musical tone control data are stored in advance in storage region 31*a* of memory device 31 at the time of purchasing (shipping) electronic musical instruments 20A to 20C. However, instead of this, one can carry out the invention by deleting storage region 31*a* so that musical tone control data are not stored at all in memory device 31 at the time of purchasing (shipping) electronic musical instruments 20A to 20C. In this case, in order to control the generation of musical tones, the user may receive the supply of musical tone control data from server 50 via internet 10 at all times, and write the supplied musical tone control data into memory device 31. This can allow memory device 31 to store only the musical tone control data desired by the user, and the amount of stored musical tone control data can be reduced, so that the capacity of memory device 31 can be restrained to the minimum.

Further, in the above-described embodiments, supply of musical tone control data exceeding the total downloading capacity from server 50 to the user is not permitted. However, regarding this supply of musical tone control data exceeding the total capacity, by charging a fee in accordance with the amount, type, and the like of the musical tone control data, supply of the musical tone control data exceeding the total downloading capacity from server 50 to the user may be permitted.

Further, in the above-described embodiments, the supply of musical tone control data from server 50 to the user is free of charge until the amount exceeds the total downloading capacity. However, one may charge a fee for every supply of musical tone control data. In this case, for each download of musical tone control data, a fee may be charged on the user in accordance with the amount, type, and the like of the musical tone control data supplied from the server 50 side to the user side. Also, in this case, musical tone control data may be supplied from server 50 to the user according as the user desires, without determining the total capacity for downloading the musical tone control data.

Furthermore, in the above-described embodiments, the present invention is applied to electronic musical instruments 20A to 20C having keyboard 21. However, the present invention can be widely applied to electronic musical apparatus having a musical tone signal generator for generating musical tone signals and a memory device capable of storing musical tone control data supplied to the musical tone signal generator for controlling the generation of the musical tone signals. For example, as this electronic musical apparatus, one can mention an electronic musical instrument having a play operator other than a keyboard, a sequencer (automatic playing apparatus) without having a play operator, a personal computer apparatus, a karaoke apparatus, and the like.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An electronic musical apparatus customizing method that is applied to an electronic musical apparatus comprising a musical tone signal generator for generating musical tone signals and a memory device capable of storing musical tone control data supplied to said musical tone signal generator for controlling generation of the musical tone signals, said method customizing the electronic musical apparatus in such a manner that desired musical tone control data to be stored into said memory device are supplied from a server having a database that stores various musical tone control data to be stored into said memory device, said various musical tone control data being applicable to plural kinds of electronic musical apparatus, to a user side that uses said electronic musical apparatus so as to allow the supplied musical tone control data to be stored into said memory device on the user side, wherein, in accordance with identification information supplied from the user side and representing individual electronic musical apparatus, musical tone control data applicable to the electronic musical apparatus represented by said identification information are presented from the server to the user side, said identification information being given to the user side at the time of purchasing the electronic musical apparatus; and musical tone control data belonging to said presented musical tone control data and selected by the user side are read out from said database, and the read-out musical tone control data are supplied from the server to the user side.

2. The electronic musical apparatus customizing method according to claim 1, wherein said identification information is a manufacture number of the electronic musical apparatus.

3. The electronic musical apparatus customizing method according to claim 1, wherein said identification information is a media access control address.

4. The electronic musical apparatus customizing method according to claim 1, wherein said electronic musical apparatus further includes a communication interface circuit that allows information exchange with the server via an internet, and said communication interface circuit inputs via said internet the musical tone control data supplied from said server to the user side for downloading into said memory device.

5. The electronic musical apparatus customizing method according to claim 1, wherein a computer apparatus is prepared on the user side for supplying to said electronic musical apparatus said musical tone control data to be supplied from the server to the user side, and said computer apparatus obtains via the internet the musical tone control data supplied from said server to the user side for downloading into the computer apparatus.

6. The electronic musical apparatus customizing method according to claim 1, wherein a part of the musical tone control data supplied to said musical tone signal generator for controlling generation of the musical tone signals is stored beforehand in said memory device, and said musical tone control data supplied from the server to the user side are additionally stored into said memory device.

7. The electronic musical apparatus customizing method according to claim 1, wherein the musical tone control data supplied to said musical tone signal generator for controlling generation of the musical tone signals are not stored beforehand in said memory device, and said musical tone control data supplied from the server to the user side are stored into said memory device.

8. The electronic musical apparatus customizing method according to claim 1, wherein said identification information is a product number of the electronic musical apparatus.

9. The electronic musical apparatus customizing method according to claim 1, wherein said identification information includes apparatus type data representing a type of the electronic musical apparatus.

10. An electronic musical apparatus customizing method that is applied to an electronic musical apparatus comprising a musical tone signal generator for generating musical tone signals and a memory device capable of storing musical tone control data supplied to said musical tone signal generator for controlling generation of the musical tone signals, said method customizing the electronic musical apparatus in such a manner that desired musical tone control data to be stored into said memory device are supplied from a server having a database that stores various musical tone control data to be stored into said memory device, said various musical tone control data being applicable to plural kinds of electronic musical apparatus, to a user side that uses said electronic musical apparatus so as to allow the supplied musical tone control data to be stored into said memory device on the user side, wherein, in accordance with identification information supplied from the user side and representing individual electronic musical apparatus, musical tone control data applicable to the electronic musical apparatus represented by said identification information are presented from the server to the user side;

musical tone control data belonging to said presented musical tone control data and selected by the user side are read out from said database, and the read-out musical tone control data are supplied from the sewer to the user side; and information representing a data amount of said musical tone control data supplied from the server to the user side is stored in association with said identification information so that musical tone control data exceeding a predetermined amount will not be supplied from the sewer to the user side.

11. An electronic musical apparatus comprising:

a musical tone signal generator for generating musical tone signals;

a memory device capable of storing musical tone control data supplied to said musical tone signal generator for controlling generation of the musical tone signals;

an interface circuit for inputting the musical tone control data supplied from outside; and a control circuit connected to said musical tone signal generator, said memory device, and said interface circuit for controlling the musical tone signal generator, the memory device, and the interface circuit, wherein musical tone control data suitable for the electronic musical apparatus, said musical tone control data being selectively supplied from a server to a user side in accordance with identification information transmitted from the user side to the server and representing said electronic musical apparatus, are stored into said memory device via said interface circuit by control of said control circuit, said identification information being given to the user side at the time of purchasing the electronic musical apparatus.

12. The electronic musical apparatus according to claim 11, wherein said identification information is a manufacture number of the electronic musical apparatus.

13. The electronic musical apparatus according to claim 11, wherein said identification information is a media access control address.

14. The electronic musical apparatus according to claim 11, wherein said interface circuit is a communication interface circuit that allows information exchange with the server via an internet, and said communication interface circuit inputs via said internet the musical tone control data supplied from said server to the user side for downloading into said memory device.

15. The electronic musical apparatus according to claim 11, wherein said interface circuit is an input circuit connected to a computer apparatus that allows information exchange with the server via an internet and is capable of inputting the musical tone control data from the computer apparatus, and the musical tone control data obtained from the server via the internet by said computer apparatus are stored into said memory device via said input circuit.

16. The electronic musical apparatus according to claim 11, wherein said interface circuit is a drive device capable of reading data recorded in a recording medium by a computer apparatus that allows information exchange with the server via an internet, and the musical tone control data obtained from the server via said internet by said computer apparatus and recorded in the recording medium are stored into said memory device via said drive device.

17. The electronic musical apparatus according to claim 11, wherein a part of the musical tone control data supplied to said musical tone signal generator for controlling generation of the musical tone signals is stored beforehand in the memory device of said electronic musical apparatus, and said musical tone control data supplied from the server to the user side are additionally stored into said memory device.

18. The electronic musical apparatus according to claim 11, wherein said identification information is a product number of the electronic musical apparatus.

19. The electronic musical apparatus according to claim 11, wherein said identification information includes apparatus type data representing a type of the electronic musical apparatus.

20. An electronic musical apparatus comprising:

a musical tone signal generator for generating musical tone signals;

a memory device capable of storing musical tone control data supplied to said musical tone signal generator for controlling generation of the musical tone signals;

an interface circuit for inputting the musical tone control data supplied from outside; and a control circuit connected to said musical tone signal generator, said memory device, and said interface circuit for controlling the musical tone signal generator, the memory device, and the interface circuit, wherein musical tone control data suitable for the electronic musical apparatus, said musical tone control data being selectively supplied from a server to a user side in accordance with identification information transmitted from the user side to the server and representing said electronic musical apparatus, are stored into said memory device via said interface circuit by control of said control circuit, the musical tone control data supplied to said musical tone signal generator for controlling generation of the musical tone signals are not stored beforehand in said memory device, and said musical tone control data supplied from the server to the user side are stored in to said memory device.

21. A server provided for an electronic musical apparatus comprising a musical tone signal generator for generating musical tone signals and a memory device capable of storing musical tone control data supplied to said musical tone signal generator for controlling generation of the musical tone signals, said server supplying musical tone control data to be stored into said memory device to a user side in response to an access from the user side, wherein said server has a database that stores various musical tone control data applicable to plural kinds of electronic musical apparatus;

said server, in accordance with identification information supplied from the user side and representing individual electronic musical apparatus, presents to the user side musical tone control data applicable to the electronic musical apparatus represented by said identification information, said identification information being given to the user side at the time of purchasing the electronic musical apparatus; and said server reads out from said database musical tone control data belonging to said presented musical tone control data and selected by the user side, and supplies the read-out musical tone control data from the server to the user side.

22. The server for an electronic musical apparatus according to claim 21, wherein said identification information is a manufacture number of the electronic musical apparatus.

23. The server for an electronic musical apparatus according to claim 21, wherein said identification information is a media access control address.

24. A server provided for an electronic musical apparatus comprising a musical tone signal generator for generating musical tone signals and a memory device capable of storing musical tone control data supplied to said musical tone signal generator for controlling generation of the musical tone signals, said server applying musical tone control data to be stored into said memory device to a user side in response to an access from the user side, wherein said server has a database that stores various musical tone control data applicable to plural kinds of electronic musical apparatus;

said server, in accordance with identification information supplied from the user side and representing individual electronic musical apparatus, presents to the user side musical tone control data applicable to the electronic musical apparatus represented by said identification information;

said server reads out from said database musical tone control data belonging to said presented musical tone control data and selected by the user side, and supplies the read-out musical tone control data from the server to the user side; and information representing a data amount of said musical tone control data supplied from the server to the user side is stored in association with said identification information so as to prevent musical tone control data exceeding a predetermined amount from being supplied to the user side.

* * * * *